US008497445B2

(12) United States Patent
Yoshida et al.

(10) Patent No.: US 8,497,445 B2
(45) Date of Patent: Jul. 30, 2013

(54) VACUUM VALVE

(75) Inventors: Shoji Yoshida, Fukiege-machi (JP); Nobuyuki Odaka, Fukiage-machi (JP); Masayuki Furusawa, Honjo (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 1215 days.

(21) Appl. No.: 11/516,787

(22) Filed: Sep. 7, 2006

(65) Prior Publication Data

US 2007/0090095 A1 Apr. 26, 2007

(30) Foreign Application Priority Data

Oct. 20, 2005 (JP) ..... 2005-305317

(51) Int. Cl.
*H01H 33/66* (2006.01)

(52) U.S. Cl.
USPC ..... 218/134; 218/118

(58) Field of Classification Search
USPC ..... 218/118, 120–126, 134–139
See application file for complete search history.

(56) References Cited

U.S. PATENT DOCUMENTS 4,077,114 A 3/1978 Sakuma
4,394,554 A * 7/1983 Warabi et al. ..... 218/134
4,414,448 A * 11/1983 Kashimoto et al. ..... 218/136
5,594,224 A * 1/1997 Tanimizu et al. ..... 218/134
5,793,008 A * 8/1998 Mayo et al. ..... 218/129
6,533,161 B1 3/2003 Gessner
6,534,738 B2 * 3/2003 Makino ..... 218/118

FOREIGN PATENT DOCUMENTS

| | | |
|---|---|---|
| DE | 229 244 A1 | 10/1985 |
| DE | 39 26 619 A1 | 11/1993 |
| DE | 195 19 419 A1 | 11/1996 |
| JP | S59-117036 | 8/1984 |
| JP | H10-199380 | 7/1998 |
| JP | 2001-006503 | 1/2001 |
| JP | 3369366 | 11/2002 |
| JP | 2004-079446 | 3/2004 |
| KR | 0242330 | 2/2000 |

* cited by examiner

*Primary Examiner* — Amy Johnson
*Assistant Examiner* — Marina Fishman
(74) *Attorney, Agent, or Firm* — Manabu Kanesaka

(57) ABSTRACT

A vacuum valve includes a hermetically sealed vessel having an insulative cylinder, an end plate at a movable electrode end, and an end plate at a fixed electrode end. The vessel accommodates a movable contact and an opposed fixed contact. The movable contact is supported through a bellows allowing the contacts to open and close while maintaining an air-tight (hermetic) seal. The bellows used in at least one embodiment is a seam type bellows without metal plating. Nickel plating layers are formed on the end plate at movable contact end and on a cover, which are joined to the bellows. The ends of the bellows are soldered with the end plate and the cover using a silver solder at the solder joints.

5 Claims, 22 Drawing Sheets

Sectional observation on a silver solder joint between base metal (SUS304 without Ni plating) and joined-side metal (SUS304 with Ni plating)

Interface between joined-side metal (SUS304 with Ni plating and silver solder layer Sectional observation on a silver solder joint between base metal (SUS304 without Ni plating) and joined-side metal (SUS304 with Ni plating)

Interface between base metal (SUS304 without Ni plating) and silver solder layer Sectional observation on a silver solder joint between a bellow (without Ni plating) and an opposite component (with Ni plating)

Interface between a bellows (without Ni plating) and a silver solder layer

VACUUM VALVE

BACKGROUND OF THE INVENTION AND RELATED ART STATEMENT

The present invention relates to a vacuum valve used in an apparatus such as vacuum circuit breaker and the like, and in particular to a technology that can effectively be applied to joining of bellows incorporated in a vacuum valve.

For example, a vacuum switch using a vacuum valve as a device to break a circuit carrying relatively heavy electric current, is known.

Japanese Patent No. 3369366, for example, discloses a structure comprising a hermetically sealed insulative vessel, the interior of which is maintained at a predetermined degree of vacuum, a contact point consisting of a fixed electrode anchored at a tip of a fixed current conduction rod and a movable electrode anchored at a tip of a movable current conduction rod. The contact is disposed in the insulative vessel. A bellows forms a part of the insulative vessel where the movable current conduction rod is inserted. One end of the bellows is hermetically fixed to the insulative vessel and the other end is hermetically fixed to the movable current conduction rod. Expansion and contraction of the bellows in the axial direction allows the movable electrode (i.e. the movable current conduction rod) to be displace in the axial direction while maintaining the vacuum in the insulative vessel. Switching of the current conduction circuit connecting to the fixed current conduction rod and the movable current conduction rod is performed by contacting and separating the fixed electrode and the movable electrode.

If the degree of vacuum is impaired in a vacuum valve having a structure as describe above, are discharge occurs between the electrodes to inhibit current switching operation of the circuit. Therefore, it is essential from the aspect of reliability of operation and to prolong the working life of the arrangement to ensure, the air tightness of the wall of the bellows itself, which expands and contracts, and at the joint between the insulative vessel and the bellows.

Consequently, the bellows is one of the most important parts of a vacuum valve. Austenitic stainless steel is generally used as the material for the bellows because of its good corrosion resistance. TIG (Tungsten-Inert-Gas) welding or silver soldering can be employed for joining ends of the bellows to an end plate and a movable current conducting rod.

TiG welding, however, involves problems that dimensions of a part relative to another part must be strictly controlled and that the quality of the joint may happen to be poor depending on welding skill of the worker.

While silver soldering does not have the above-mentioned problem as TIG welding, attention must be paid to the surface characteristic of the article to be soldered. For, example, austenitic stainless steel, a possible material for bellows, can have an oxide film on the surface thereof, and as result, does not exhibit satisfactory wettability with the silver solder due to this oxide film, irrespective that it resides in excellent corrosion resistance.

Consequently, the surface of bellows is normally plated with nickel in order to secure wettability of silver solder. Japanese Patent Unexamined Publication No. 2004-79446 discloses nickel plating on a solder joint of bellows.

However, the nickel plating on a bellows, which generally has a small thickness and a complicated shape, cannot be carried out using a batch process such as barrel plating, which allows many bellows to be processed at one time, in a manner which prevents imperfections such as pits. Consequently, it is unavoidable to use an individual plating process such as rack plating, which takes much time and work. Therefore, the plating itself, which is a prerequisite for employing soldering, leads to considerably high cost.

A bellows that is an object of silver soldering can be a so-called seamless type bellows as describe in Japanese Patent Unexamined Publication No. 2001-6503.

A seamless type bellows is normally manufactured using a procedure wherein a disk is punched by blanking from a sheet having a thickness of about 0.5 mm. The disk is subjected to a procedure including repeated steps of cleaning, lubricating, deep drawing, cleaning, annealing, lubricating, deep drawing, and so on, to obtain a deep cylindrical cup having a pipe-shaped side wall about 0.1 mm thick and a bottom plate (enclosing end of the cup) relatively thick (a thickness of the raw sheet i.e. about 0.5 mm). This cup is subjected to hydraulic pressure on the inner wall thereof forming ribs to obtain a bellows.

As described above, a bellows of the seamless type is manufactured through a rather complicated multiple steps, so it is considerably expensive, which is problematic.

To incorporate this seamless type bellows having a bottom plate into a vacuum valve, as described in the Japanese Patent Unexamined Publication No. 2001-6503 mentioned previously, a through hole for an electrode is bored at the bottom, and the bellows, a bellows shielding member, and a binding ring are stacked and fixed by soldering. This integrating structure is necessary but rather complicated.

The complexity of the integrating structure may cause insufficient filling of the solder in the gaps between the bellows, the bellows shielding member, and the binding ring. Thus, there is concern with respect to degradation of strength and air tightness at the solder joint.

In light of the above problems, an object of the present invention is to attain low cost in a vacuum valve including a soldering structure in a movable portion of a bellows.

Another object of the invention is to shorten the manufacturing period for a vacuum valve including a soldering structure in a movable portion of a bellows.

Still another object of the invention is to improve strength and air tightness of the joint in the soldering structure in a movable portion of a bellows in a vacuum valve.

SUMMARY OF THE INVENTION

A first aspect of the present invention resides in a vacuum valve comprising a hermetically sealed vessel accommodating a fixed contact piece and a movable contact piece. The hermetically sealed vessel comprises a first structural member having a metal plating thereon, a bellows free of metal plating, and a second structural member having a metal plating thereon. The first structural member intervenes between the movable contact piece and the bellows and is soldered with one end portion of the bellows, and the other end portion of the bellows is soldered with the second structural member.

A second aspect of the present invention resides in the vacuum valve according to the first aspect, wherein the bellows is manufactured through a welding step in which a stainless steel sheet is rolled to a cylindrical shape and a seam line on a side face is welded; and a forming step in which a ribbed portion is formed in the pipe. The bellows has the ribbed portion permitting expansion and contraction and cylindrical end portions at both sides of the ribbed portion.

A third aspect of the present invention resides in the vacuum valve according to the first aspect, wherein the first and second structural members are composed of mild steel, copper, stainless steel, or a sealing alloy of iron-nickel alloy or iron-nickel-cobalt alloy.

A fourth aspect of the present invention resides in the vacuum valve according to the first aspect, wherein the metal plating is gold plating or nickel plating, and the first and second structural members are soldered with the bellows using a silver solder.

A fifth aspect of the present invention resides in the vacuum valve according to the first aspect, wherein a soldered place or zone between the bellows and the first structural member contains a metallic component that is transferred from the metal plating of the first structural member, and a soldered place between the bellows and the second structural member contains a metallic component that is transferred from the metal plating of the second structural member.

A sixth aspect of the present invention resides in the vacuum valve according the first aspect, wherein the bellows comprises a ribbed portion permitting expansion and contraction, and opening end portions with a cylindrical shape at both sides of the ribbed portion. The first structural member comprises a through hole through which the movable electrode extends, and a step formed around the through hole. An outer surface of one of the opening end portions of the bellows is soldered with an inner surface of the step of the first structural member.

A seventh aspect of the present invention relates to a method of producing a vacuum valve comprising a hermetically sealed vessel accommodating a fixed contact piece and a movable contact piece, wherein the hermetically sealed vessel comprises a first structural member having a metal plating thereon, a bellows free of metal plating, and a second structural member having a metal plating thereon, and supports the movable contact piece through the bellows, the method comprising: a first step of preparing the first structural member, the bellows, and the second structural member, wherein the first structural member intervenes between the movable contact piece and the bellows and is placed adjacent to one end portion of the bellows, and the other end portion of the bellows is placed adjacent to the second structural member; and a second step of soldering the first structural member and the bellows, and soldering the bellows and the second structural member.

An eighth aspect of the present invention resides in the method of producing a vacuum valve according to the seventh aspect, wherein the bellows is manufactured in the first step through a welding process to form a pipe by rolling a stainless steel sheet into a cylindrical shape and welding a seam line on a side surface of the rolled sheet, and through a forming process to form ribs on the pipe.

A ninth aspect of the present invention resides in the method of producing a vacuum valve according to the seventh aspect, wherein the first and second structural members are composed of mild steel, copper, stainless steel, or a sealing alloy of iron-nickel alloy or iron-nickel-cobalt alloy.

A tenth aspect of the present invention resides in the method of producing a vacuum valve according to the seventh aspect, wherein the metal plating is a gold plating or a nickel plating.

An eleventh aspect of the present invention resides in the method of producing a vacuum valve according to the seventh aspect, wherein the second step of soldering is carried out using a silver solder.

A twelfth aspect of the present invention resides in the method of producing a vacuum valve according to the seventh aspect, wherein a metallic component of the metal plating on the first structural member is transferred to the bellows in soldering process of the first structural member with the bellows in the second step; and a metallic component of the metal plating on the second structural member is transferred to the bellows in soldering process of the second structural member with the bellows in the second step.

A thirteenth aspect of the present invention resides in a method of producing a vacuum valve in which structural members of a hermetically sealed vessel for accommodating electrical contacts are soldered with a bellows to permit the contacts to contact and separate while maintaining air tightness, the method comprising a first step of plating a metal plating on the structural members; and a second step of soldering the structural members with the bellows that is free of metal plating.

A fourteenth aspect of the present invention resides in the method of producing a vacuum valve according to the thirteenth aspect, wherein the bellows is manufactured in the first step through a welding process to form a pipe by rolling a stainless steel sheet into a cylindrical shape and to weld a seam line on a side surface of the rolled sheet, and through a forming process to form ribs on the pipe.

A fifteenth aspect of the present invention resides in the method of producing a vacuum valve according to the thirteenth aspect, wherein the structural members are composed of mild steel, copper, stainless steel, or a sealing alloy of iron-nickel alloy or iron-nickel-cobalt alloy.

A sixteenth aspect of the present invention resides in the method of producing a vacuum valve according to the thirteenth aspect, wherein the metal plating of the structural members is gold plating or nickel plating, and the soldering process is carried out using a silver solder.

A seventeenth aspect of the present invention resides in the method of producing a vacuum valve according to the thirteenth aspect, wherein a metallic component of the metal plating of the structural member is transferred to the bellows in soldering process of the structural member with the bellows in the second step.

In a soldering bellows structure in a vacuum valve according to the invention, metal plating is not conducted on the bellows itself, but conducted on opposite structural members, thereby reducing the cost of bellows. The metal plating here is carried out on a structural member that has a relatively simple shape and rarely causes damages such as pits by employing a method for example, barrel plating, which allows easy and mass processing. Therefore, the cost of metal plating is reduced.

More cost reduction is achieved by using a seam type bellows, which is not expensive. That is to say, a seam type bellows, inherently in its manufacturing method, has openings with cylindrical shape at both ends thereof. In the process of soldering the peripheral external surface of the opening portion with an opposite structural member, because of a simple form of the gap between the peripheral external surface of the opening portion and the structural member, this gap is surely filled with solder, thereby improving strength and air tightness of the solder joint.

The present invention achieves cost reduction of a vacuum valve including a soldering structure of a bellows in a movable part.

The invention also achieves shortening of a manufacturing period of a vacuum valve including a soldered bellows structure as a movable part.

The invention further achieves improvement of strength and air tightness in a soldered bellows structure in a vacuum valve including a soldered bellows structure as a movable part.

DETAILED DESCRIPTION OF PREFERRED EMBODIMENTS

Some of the preferred embodiments of the present invention will be described in detail with reference to the accompanying drawings.

Figure 1:
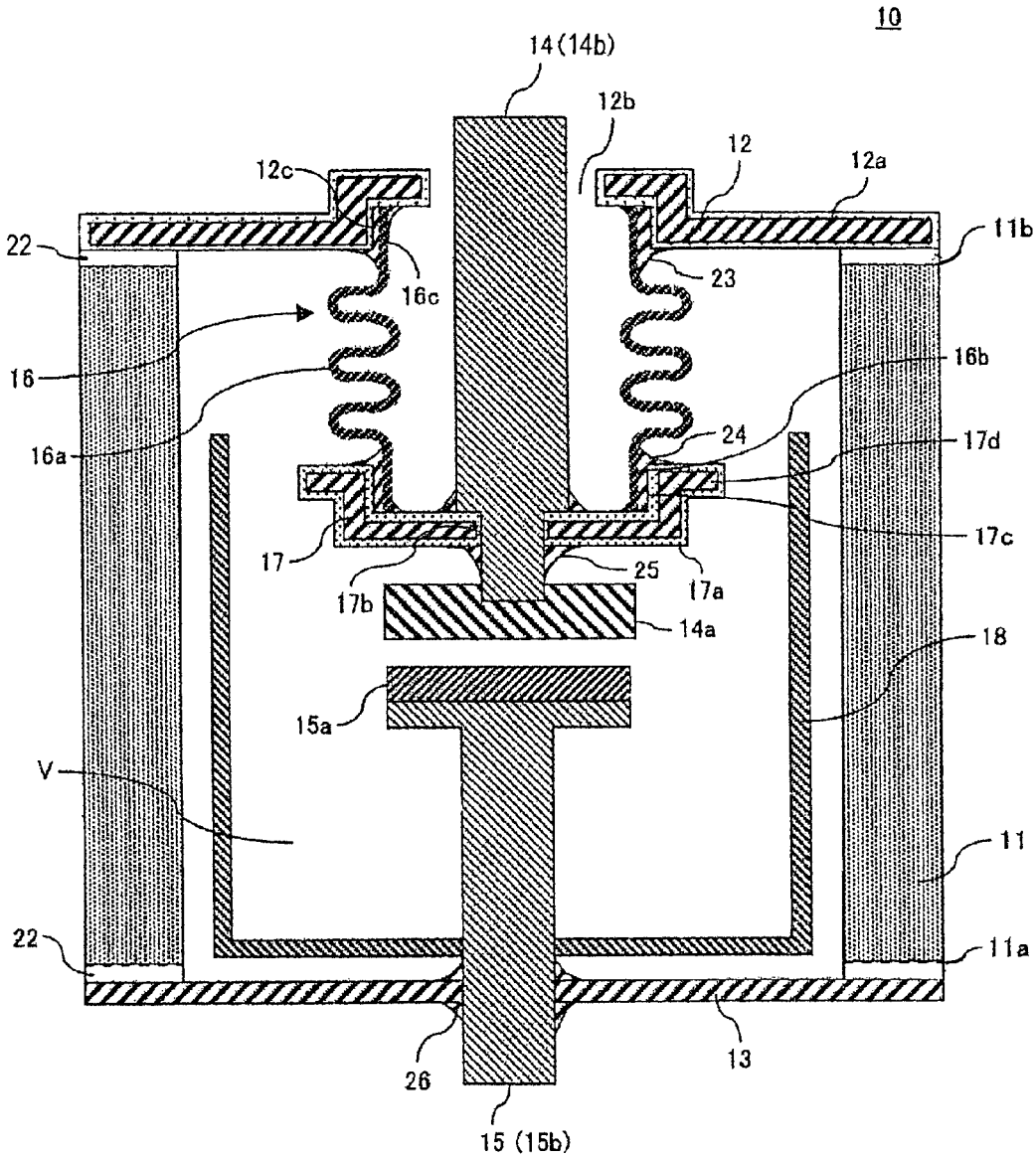
FIG. 1 is a sectional view of a vacuum valve according to an embodiment of the present invention.

FIG. 1 is a sectional view showing an example of a structure of a vacuum valve according to an embodiment of the present invention. The vacuum valve 10 in this embodiment comprises an insulative cylinder 11, an end plate 12 at a movable electrode end, an end plate 13 at a fixed electrode end, a movable contact element 14, a fixed contact element 15, a bellows 16, a cover 17, and an are shield 18.

The insulative cylinder 11 is made of an insulative material such as a ceramic. A metallization layer 11*a* and a metallization layer 11*b* are formed at bottom and top ends of the insulative cylinder 11, respectively.

The metallization layer 11*a* and the metallization layer 11*b* at both ends of the insulative cylinder 11 adhere to the fixed electrode end plate 13 and the movable electrode end plate 12 through solder joint 22 and solder joint 21, respectively, thereby composing a hermetically sealed vessel V (hereinafter hermetically sealed vessel V) having an interior space maintained at a predetermined degree of vacuum.

Inside the insulative cylinder 11 composing the hermetically sealed vessel V, a fixed contact element 15 extending through the end plate 13 at the fixed electrode end and a movable contact element 14 extending through the end plate 12 at the movable electrode end, are disposed in opposition to each other.

The movable contact element 14 comprises a movable contact piece 14*a* at an opposing tip and a movable conduction rod 14*b* supporting the movable contact piece 14*a* from rear side.

The fixed contact element 15 comprises a fixed contact piece 15*a* at an opposing tip and a fixed conduction rod 15*b* supporting the fixed contact piece 15*a* from rear side.

The fixed contact element 15 extending through the end plate 13 is hermetically fixed to this end plate 13 through solder joint 26.

Inside the hermetically sealed vessel V, a cup-shaped are shield 18 is attached to the fixed contact element 15, enclosing the space where the fixed contact piece 15*a* and the movable contact piece 14*a* are opposing. The are shield 18 is provided to prevent the inner wall of the insulative cylinder 11 from contamination due to are discharge generated on current switching by contact and opening of the fixed contact piece 15*a* and the movable contact piece 14*a*.

Figure 2A:
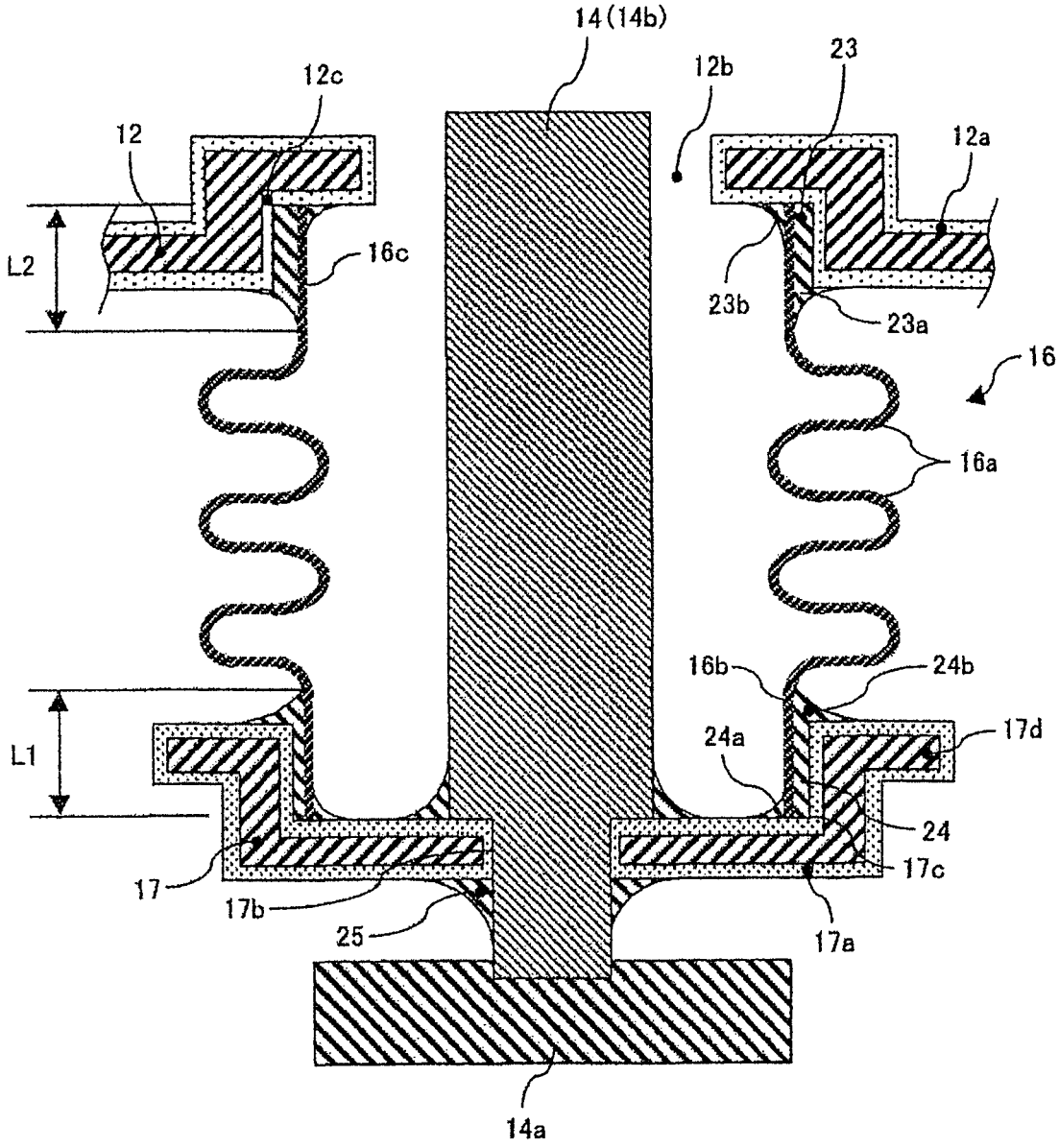
FIG. 2A is an enlarged sectional view of joining parts of a bellows in a vacuum valve according to an embodiment of the present invention.

FIG. 2A is an enlarged sectional view of the region where the movable contact element 14 extends through the end plate 12.

A bellows 16 is provided in the region where the movable contact element 14 extends through the end plate 12. The bellows 16, while allowing the movable contact element 14 to displace in the axial direction, ensure air tightness in the region where the movable contact element 14 extends through the end plate 12.

The bellows 16 consists of an expansible ribbed portion 16*a* and cylindrical opening end portions 16*b* and 16*c* in the both sides of the ribbed portion. Each opening end portion has a cylindrical shape and a longitudinal section approximately parallel to the axial direction.

The bellows can be made of stainless steel, for example. The bellows can be a seam type bellows that is manufactured by a method described later. Neither the inner and outer surfaces of the bellows 16, in this embodiment, are provided with metal plating and comprise the raw material from which the bellows is produced.

The whole surface of the end plate at movable side 12, is coated with a nickel plating layer 12*a*. The end plate at movable side 12 has a through hole 12*b* in the central region thereof for the movable contact element 14 to extend through. A step part 12*c* is provided concentrically to the through hole 12*b* and protrudes out of the hermetically sealed vessel V.

The inner circumference of the step part 12*c* and the opening end portion 16*c* of the bellows 16 are hermetically soldered with a solder such as silver solder at a solder joint 23. In the solder joint 23, the whole circumference of the gap between the outer surface of the opening end portion 16*c* and the inner circumferential surface of the step art 12*c*, is filled with solder material, while fillet 23*a* and fillet 23*b* are formed on outer and inner circumferences, respectively, of the opening end portion 16*c* of the bellows 16.

The other opening end portion 16*b* of the bellows 16 is hermetically combined with the movable contact element 14 through the cover 17.

The cover 17 is totally coated with nickel plating layer 17*a* and has a through hole 17*b* in the central region thereof for the movable contact element 14 to extend through. The inner circumference of the through hole 17*b* and the outer peripheral surface of the movable contact element 14 are hermetically fixed with a solder at the solder joint 25.

The cover 17 has a step part 17*c* concentric to the through hole 17*b* which protrudes towards inside of the hermetically sealed vessel V. A flange 17*d* is provided on the outer periphery of the step part 17*c*. The flange 17*d* shields the bellows 16 from the region where the movable contact piece 14*a* and the fixed contact piece 15*a* are in opposition in the hermetically sealed vessel V.

The inner circumferential surface of the step part 17*c* and the outer surface of the opening end portion 16*b* of the bellows 16 are hermetically joined together with a solder in the solder joint 24. In the solder joint 24, the whole circumference of the gap between the outer surface of the opening end portion 16*b* and the inner circumferential surface of the step part 17*c* is filled with solder material, while fillet 24*a* and fillet 24*b* are formed on inner and outer circumferences, respectively, of the opening end portion 16*b* of the bellows 16.

The bellows used in this embodiment is not a seamless type produced by deep drawing, but a seam type bellows 16 manufactured by a process as described hereinlater. As a result, the both ends of the bellows 16, the opening end portions 16*b* and 16*c*, have a cylindrical shape with uniform diameter along the axial direction in the same condition as manufactured.

Accordingly, the place of combining the bellows 16 and the cover 17 (and consequently to the movable contact element 14) has a simple structure in which the opening end portion 16*b* of the bellows 16 is inserted into the step part 17*c* of the cover 17 along the axial direction and fitted. This simple structure allows the gap between the opening end portion 16*b* and the step part 17*c* at the solder joint 24 to completely fill with solder, thus forming smooth-shaped fillet 24*a* and fillet 24*b*.

Likewise, the place of combining the bellows 16 to the end plate at movable side 12 also has a simple structure in which the opening end portion 16*c* of the bellows 16 is fitted into the step part 12*c* of the end plate at movable side 12 along the axial direction. The gap between the opening end portion 16*c* and the step part 12*c* at the solder joint 23 is also completely filled with solder, thus forming smooth-shaped fillet 23*a* and fillet 23*b*.

Therefore, joining strength and air tightness are improved at the solder joint 24 and the solder joint 23. The joining strength and air tightness at the solder joint 24 can be set to a desired degree by adjusting the joint length L1 in the axial direction of the opening end portion 16*b* of the bellows 16 to control the axial length of the solder joint 24. In the same way, the joining strength and air tightness at the solder joint 23 can be set to a desired degree by adjusting the joint length L2 in the axial direction of the opening and portion 16*c* of the bellows 16 to control the axial length of the solder joint 23.

Figure 2B:
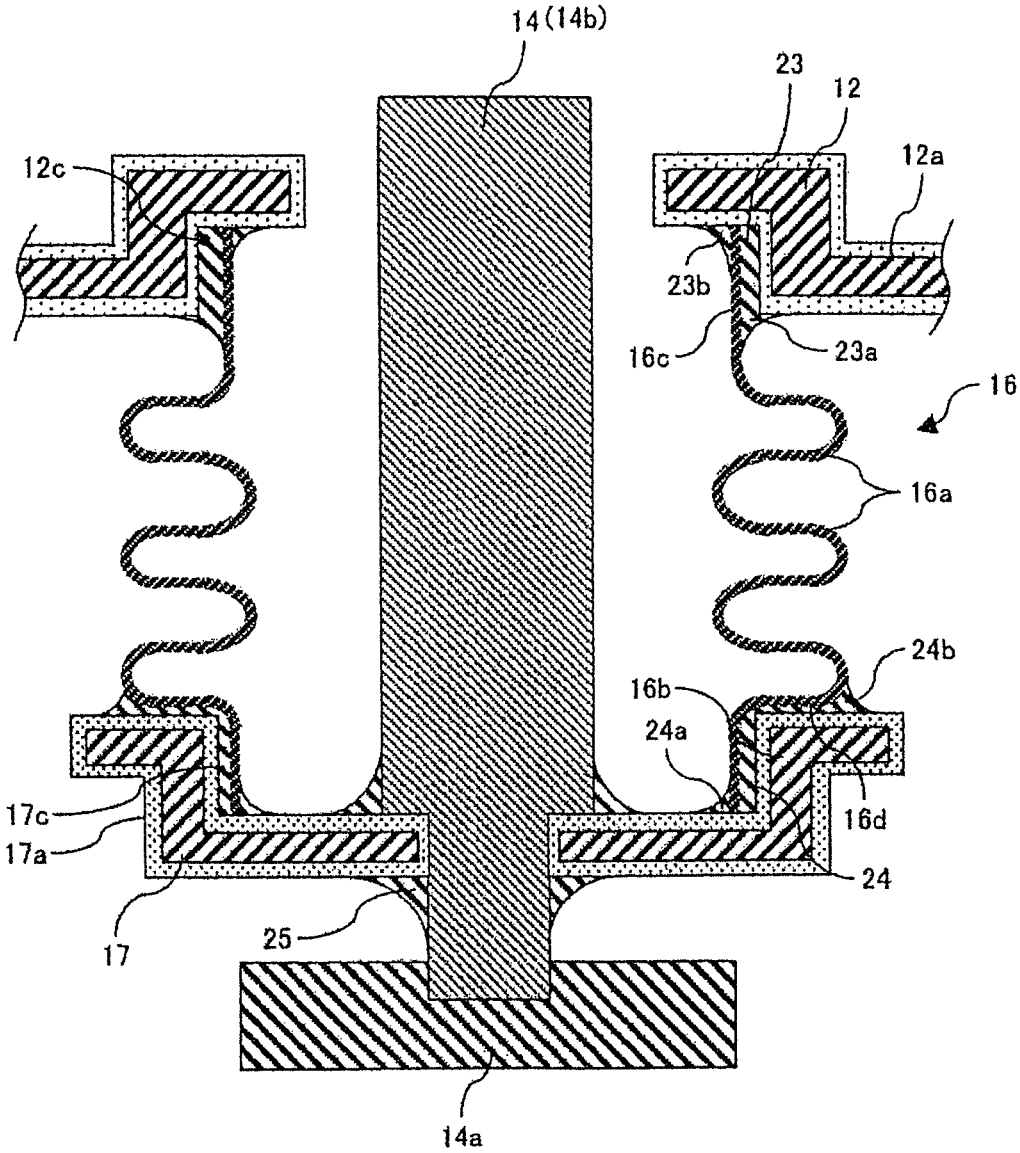
FIG. 2B is an enlarged sectional view showing a variation of joining parts of a bellows in a vacuum valve according to an embodiment of the present invention.

FIG. 2B depicts a variation in the solder joint 24 between the bellows 16 and the cover 17. The solder joint 24 in this variation utilizes, for a part of joining surface, the part of external surface 16*d* of the expansible ribbed portion 16*a* of the bellows 16 that is next to the opening end portion 16*b* and which resides in a surface approximately perpendicular to the axial direction of the bellows 16, in addition to the outer surface of the opening end portion 16*b*. This variant structure further improves the joining strength and air tightness of the solder joint 24.

Figure 3:
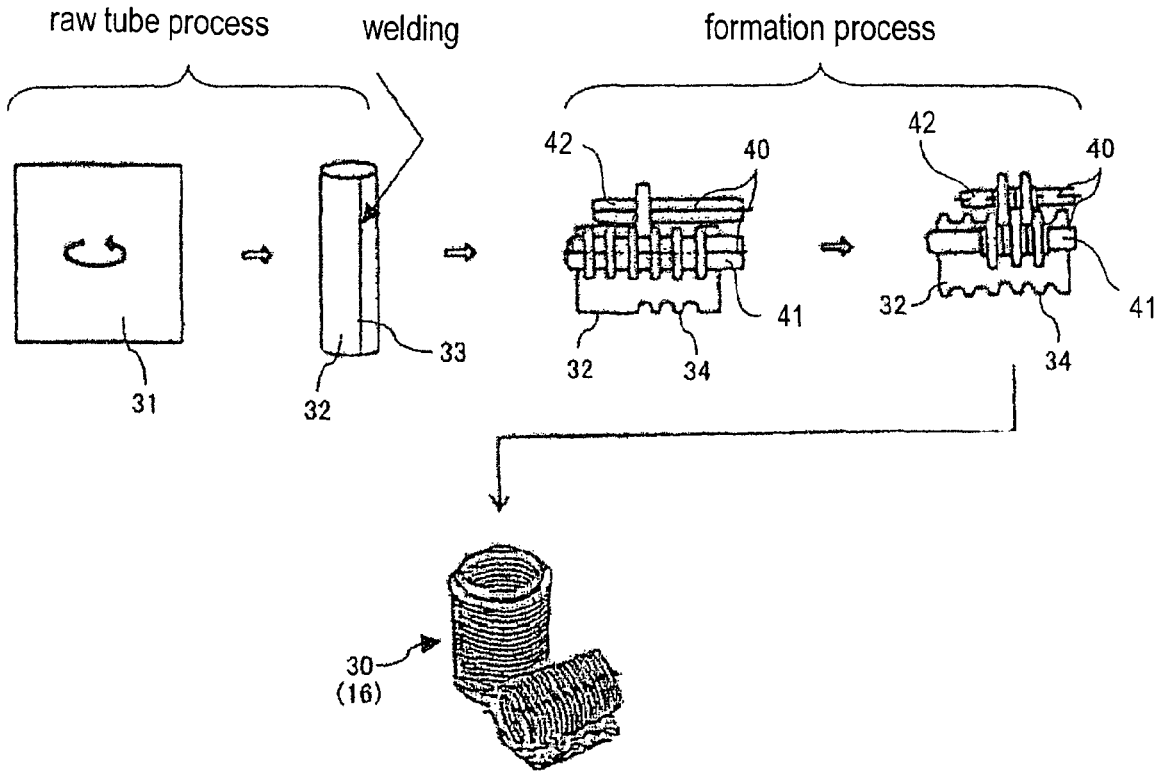
FIG. 3 illustrates an example of procedure for manufacturing a bellows included in a vacuum valve according to an embodiment of the present invention.

FIG. 3 illustrates an example of procedure for manufacturing the bellows 16 according to an embodiment of the present invention.

A rectangular sheet 31 of stainless steel, for example, is rolled up to form a pipe 32 and the seam 33 in the axial direction on the side surface of the pipe 32 is welded. Then, on the central portion, in the axial direction, of the pipe 32, expansible ribbed portion 34 (expansible ribbed portion 16*a*) is formed using a forming jig 40 composed of a base jig 41 having a base mold of ribs formed on the periphery thereof, and a press jig 42 having protrusions with the pitch of the ribs. In the forming process, the base jig 41 is inserted into the pipe 32 and the press jig 42 presses against the base jig 41 across the wall of the pipe 32 in the radial inward direction of the pipe. Thus, a corrugated bellows 30 (bellows 16) is obtained.

Instead of using a forming jig 40, a bellows 30 can be manufactured through a process in which the pipe 32 is inserted into a cylindrical mother die having ribs on inside wall thereof and hydraulic pressure is applied from inside of the pipe 32 to expand the pipe 32 to assume the shape of the mother die.

These methods of manufacturing a bellows 30 as described above, forming the ribbed portion 34 leaving the both end portions of the pipe 32 as in an original cylindrical shape, can provide, readily in a short period, a bellows 16 according to an embodiment of the present invention, the bellows 16 having an expansible ribbed portion 16*a* in the central portion in the axial direction and simple cylindrical opening end portion 16*b* and opening end portion 16*c* at both end portions. A seam type bellows 16 in an embodiment of the invention can be manufactured in a shorter period than a seamless type bellows of a prior art, which involves a complicated manufacturing procedure. Consequently, a period of manufacturing a vacuum valve 10 that uses the bellows 16 can also be shortened according to the manufacturing method of the invention.

In the vacuum valve 10 having a structure in an embodiment of the invention, the movable contact element 14 and the fixed contact element 15 are connected to a desired electric circuit and the movable contact piece 14*a* and the fixed contact piece 15*a* contact one another establishing an electrically conductive circuit. When the electric circuit is to be broken in an event of some trouble, the movable contact element 14 supported on the bellows 16 is displaced in response to an external signal and separates from the fixed contact element 15. The movable contact piece 14*a* and the fixed contact piece 15*a* are separated and assume a non-conductive state. The vacuum within the hermetically sealed vessel V prevents dielectric breakdown and are discharge.

Thus, the bellows 16 capable of expansion and contraction can execute on-off operation of an electric circuit through contact and separation of the movable contact piece 14*a* and the fixed contact piece 15*a* while maintaining the vacuum within the hermetically sealed vessel V.

In the embodiment of the invention as described herein, the bellows has no metal plating thereon, and only the end plate at movable side 12 and the cover 17 are coated with a nickel plating layer 12*a* and a plating layer 17*a*. Further, the opening end portion 16*c* of the bellows 16 and the end plate at movable side 12 are joined with a silver solder, for example, at the solder joint 23; and the opening end portion 16*b* of the bellows 16 and the cover 17 are joined with a silver solder at the solder joint 24.

The specific examples described later have proven that satisfactory joint strength and air tightness are ensured with the structure in which the bellows 16 has no metal plating and only the opposite components of the end plate at movable side 12 and the cover 17 are provided with the nickel plating layer 12*a* and the nickel plating layer 17*a*. The structure of the vacuum valve in this embodiment of the invention is based on the knowledge derived from specific examples.

As described earlier, a method of silver plating of a bellows in a conventional vacuum valve uses a seamless type bellows that is manufactured by deep drawing of a sheet of austenitic stainless steel. This seamless type bellows is coated with a nickel plating, as described in Japanese Patent Unexamined Publication No. 2004-79446, by means of suspension plating or electroless plating, which both takes much time and work.

Moreover, the integrating structure of the bellows and the electrode, as described in Japanese Patent Unexamined Publication No. 2001-6503, is rather complicated in which a through hole for the electrode is bored at the thick bottom plate of the seamless bellows, and the bellows, a bellows shielding member, and a binding ring are stacked, held at the step part of the electrode and then fixed by soldering.

Thus, the prior art needs the used of an expensive seamless type bellows and nickel plating on the bellows. The high cost of the bellows itself and the necessity of nickel plating add to the costs.

In view of above described circumstances, the inventors of the present invention have carried out detailed studies on the methods of inexpensive silver soldering on a bellows in a vacuum valve 10 according to the embodiment of the invention, as described in the following. The structure of the vacuum valve 10 according to the embodiment of the invention as described previously is an application of the knowledge obtained through actual experiments.

Some preliminary experiments on soldering have been carried out using various materials. The materials used in the experiments were oxygen-free copper plate (C1020P, a material code prescribed in Japanese Industrial Standards, as well as for "SPCC" and "SUS304CP" below), cold rolled steel plate (SPCC), and cold rolled stainless steel plate (SUS304CP). Dimensions of the samples were a thickness of 2 to 3 mm and a square with a side of about 30 mm. The surface of the sample was treated only by degreasing in a solvent in the cases without nickel plating.

Preliminary Example 1

Figure 4A:
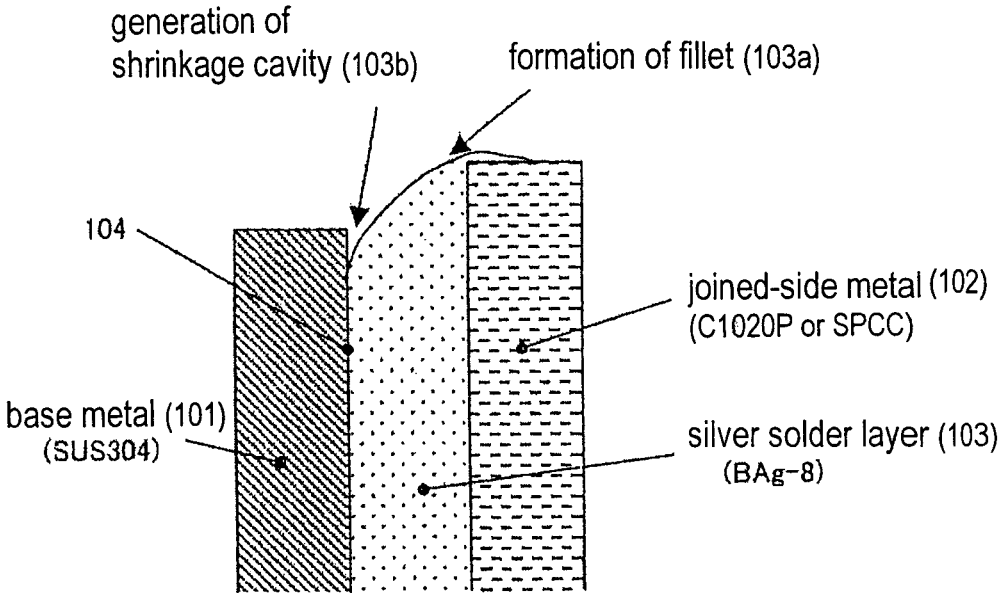
FIG. 4A illustrates Preliminary Example 1 for joining a bellows used in a vacuum valve.

A foil of silver solder (72Ag—Cu) was put between a plate of SUS304 without nickel plating (temporarily regarded as a base metal 101) and C1020P, SPCC, or SUS304CP (temporarily regarded as a joined-side metal 102). These combinations were heated up to 800° C. in a high vacuum environment at a pressure within $10^{-2}$ Pa to join the base metal 101 and the joined-side metal 102 via the silver solder layer 103. In the combination of base metal 101 (SUS304)/joined-side metal 102 (C1020P or SPCC), a fillet 103*a* with a shape of spindle was formed in the side of joined-side metal 102, which is C1020P or SPCC, while in the side of base metal SUS304, shrinkage cavity 103*b* was formed, as shown in FIG. 4A.

Figure 4B:
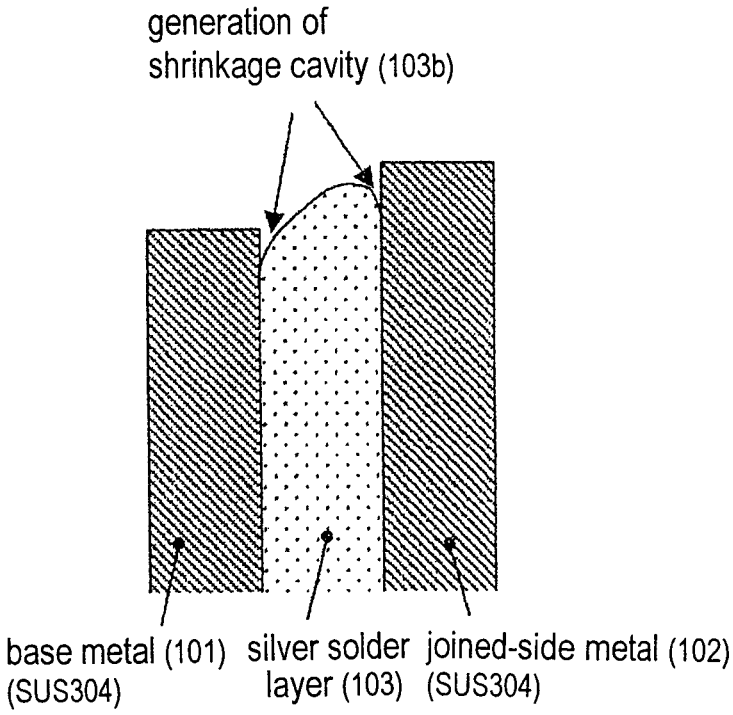
FIG. 4B illustrates a variation of Preliminary Example 1 for joining a bellows used in a vacuum valve.

In the combination of the base metal 101 of SUS304 and the joined-side metal 102 of SUS304, large shrinkage cavities 103*b* were formed in both sides of base metal and joined-side metal, as shown in FIG. 4B.

This has occurred because a little contamination and oxide present on the surface of C1020P and SPCC are decomposed by the reduction action produced by the heating in the vacuum, resulting in good wettability. In the case of the material SUS304, an oxide film is formed on its surface and the oxide film is unable to be eliminated by heating in a vacuum. As a result, a SUS304 without nickel plating exhibits poor wettability and does not permit good hermetic joint to be performed in a condition without nickel plating or other special treatment.

Preliminary Example 2

Next, similar soldering experiments were carried out using the combinations of a base metal 101 of SUS304 plate with nickel plating and a joined-side metal 102 of C1020P, SPCC, or SUS304CP without nickel plating.

Figure 5A:
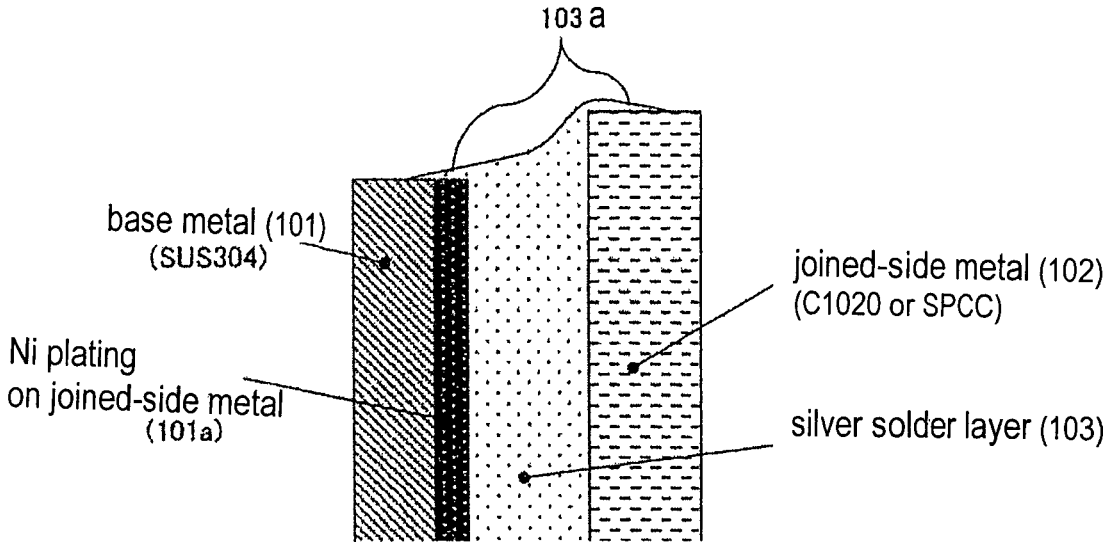
FIG. 5A illustrates Preliminary Example 2 for joining a bellows used in a vacuum valve.

In the combination of base metal 101 (SUS304 with nickel plating)/joined-side metal 102 (C1020P or SPCC), a spindle-shaped solder fillet 103*a* was formed on the surface of either side of base metal 101 and joined-side metal 102 as shown in FIG. 5A. Thus, SUS304 that essentially exhibits poor wettability with silver solder can irrespectively show good soldering ability when coated with a nickel plating (101*a*).

Figure 5B:
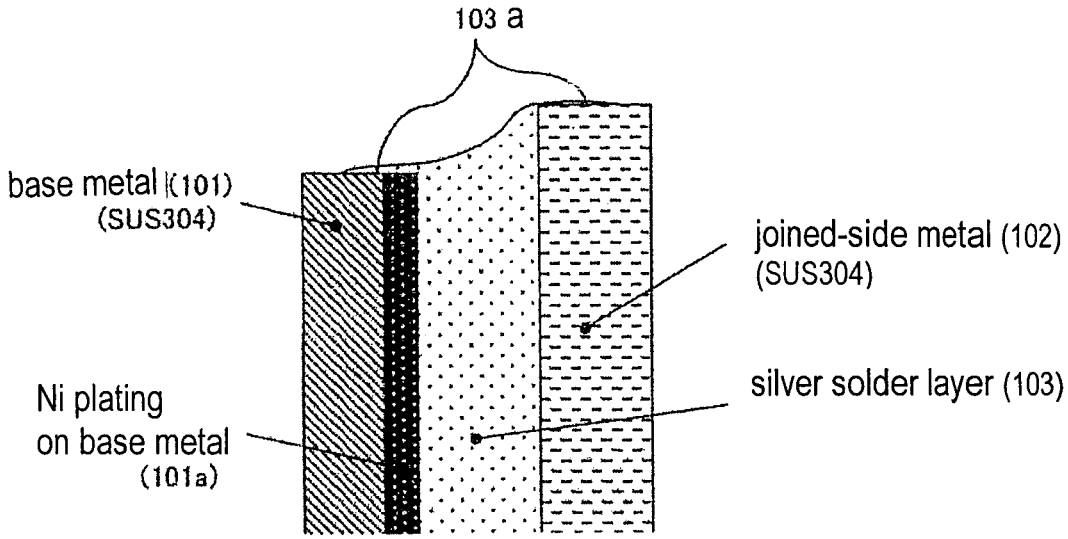
FIG. 5B illustrates a variation of Preliminary Example 2 for joining a bellows used in a vacuum valve.

A peculiar phenomenon was been observed, as shown in FIG. 5B, with the combination of base metal 101 (SUS304 with nickel plating)/joined-side metal 102 (SUS304CP without nickel plating). A spindle-shaped solder fillet 103*a* was formed showing a well soldered condition as in FIG. 5B at the side of joined-side metal 102 of SUS304 without nickel plating, which should show poor wettability with silver solder due to its intrinsic nature.

The reason for this can be assumed that the nickel plating 101*a* formed on the base metal 101 (SUS304) partly dissolves in the process of soldering at 800° C. to 850° C. and precipitates on the surface of the joined-side metal 102 (without nickel plating) during the process of solidification of the silver solder as if nickel plating is carried out on the joined-side metal 102.

Further soldering experiments were conducted, in the same manner as the above-described soldering, in the combination of a base metal 101 of a SUS304 plate with nickel plating and C1020P, SPCC, or SUS 304CP with nickel plating. As a matter of course, good fillets 103*a* were formed at both sides of base metal 101 and joined-side metal 102 in every combination.

Although contaminations and oxide films must be present also on the surface of the nickel plating, they are readily eliminated by heating in a vacuum, resulting in good wettability with silver solder.

Example 1

Figure 6:
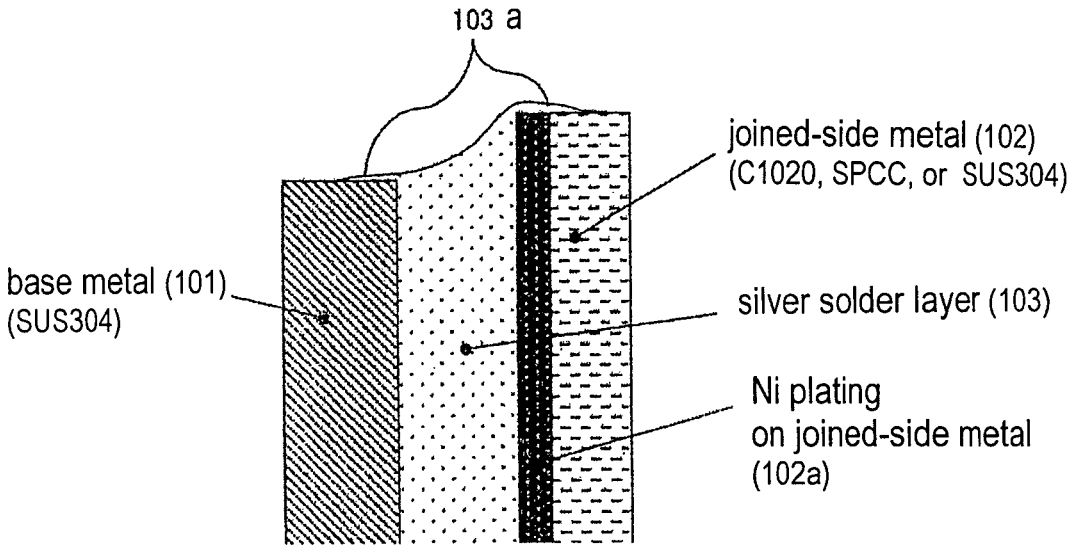
FIG. 6 illustrates Example 1 of a method of joining a bellows according to an embodiment of the present invention.

Based on the knowledge obtained in the Preliminary Examples described above, three types of samples were produced in three combinations of a base metal 101 of SUS304 without plating and joined-side metals 102 of C1020P, SPCC, and SUS304 each having nickel plating (plating on joined-side metal 102*a*) thereon. Observing the result of the soldering, it has been shown as in FIG. 6, that fillet 103 was formed in every combination even at the side of base metal 101 of SUS 304 without nickel plating indicating satisfactory soldered condition.

Table 1 summarizes the results of above-described experiments. Marks in the table entry indicate the soldered condition at the base metal side/at the joined-side metal, o indicating formation of solder fillet 103*a* and well soldered condition, an X indicating absence of fillet and a badly soldered condition.

TABLE 1

| | | joined metal-side | | | | | |
|---|---|---|---|---|---|---|---|
| | | No Ni plating | | | with Ni plating | | |
| Example | base metal | C1020P | SPCC | SUS304 | C1020P | SPCC | SUS304 |
| Preliminary Example 1 | SUS304 without Ni plating | x/o | x/o | x/x | — | — | — |
| Preliminary Example 2 | SUS304 with Ni plating | o/o | o/o | o/o | o/o | o/o | o/o |
| Embodiment Example 1 | SUS304 without Ni plating | — | — | — | o/o | o/o | o/o |

Based on these experiments, detailed observations have been made on the cross section of the samples.

FIGS. 7A, 7B, 7C, 7D, 8A, 8B, 8C, and 8D depict the results of observation and measurement of concentration distribution of the elements of Fe, Cr, and Ni that are main component of SUS304, Ag and Cr that are the main components of silver solder, and Ni of the Ni plating, in the cross-section of soldered part of the base metal 101 that is SUS304 without nickel plating with the joined-side metal 102 that is SUS304 with nickel plating, using EPMA (electron probe micro analysis).

Figure 7A:
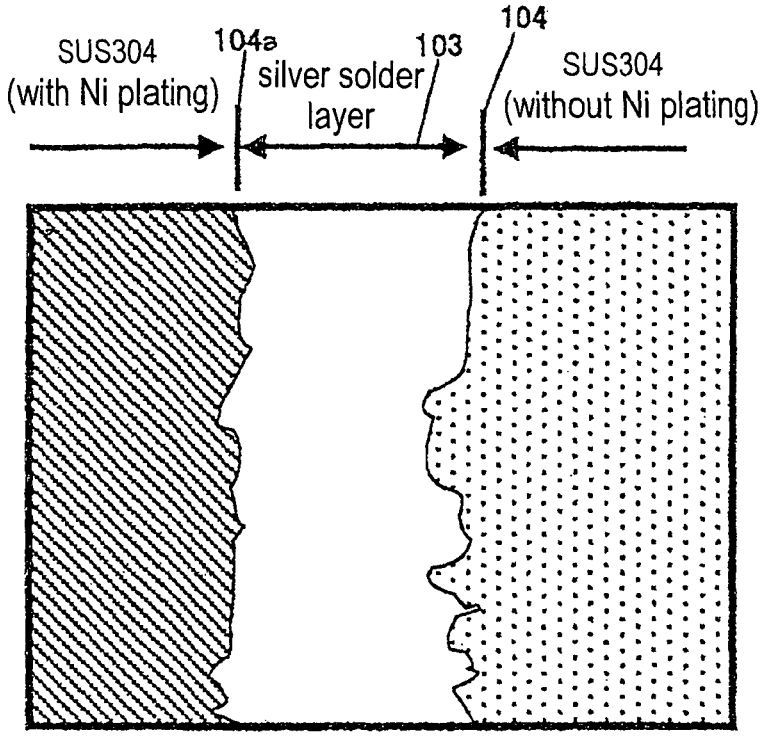
FIG. 7A is a depiction of a soldered part composed of a joined-side metal, a silver solder layer, and a base metal as per Example 1 of joining a bellows according to an embodiment of the present invention.
Figure 7B:
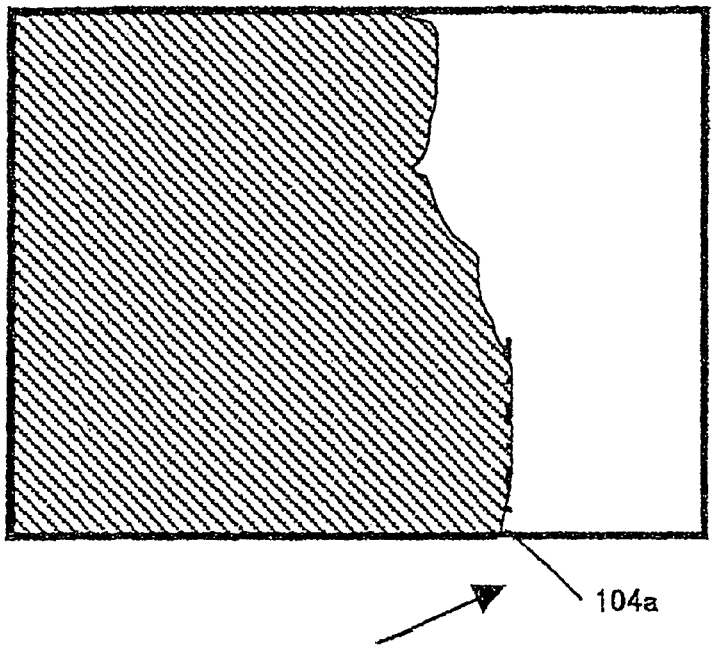
FIG. 7B is a depiction of a joint interface between a joined-side metal and a silver solder layer as per Example 1 of joining a bellows according to an embodiment of the present invention.

More specifically, FIG. 7A is a depiction of a sectional observation of a soldered part composed of a joined-side metal 102, a silver solder layer 103, and a base metal 101; and FIG. 7B is a depiction of a sectional observation of a joint interface 104*a* between a joined-side metal 102 and a silver solder layer 103.

Figure 7C:
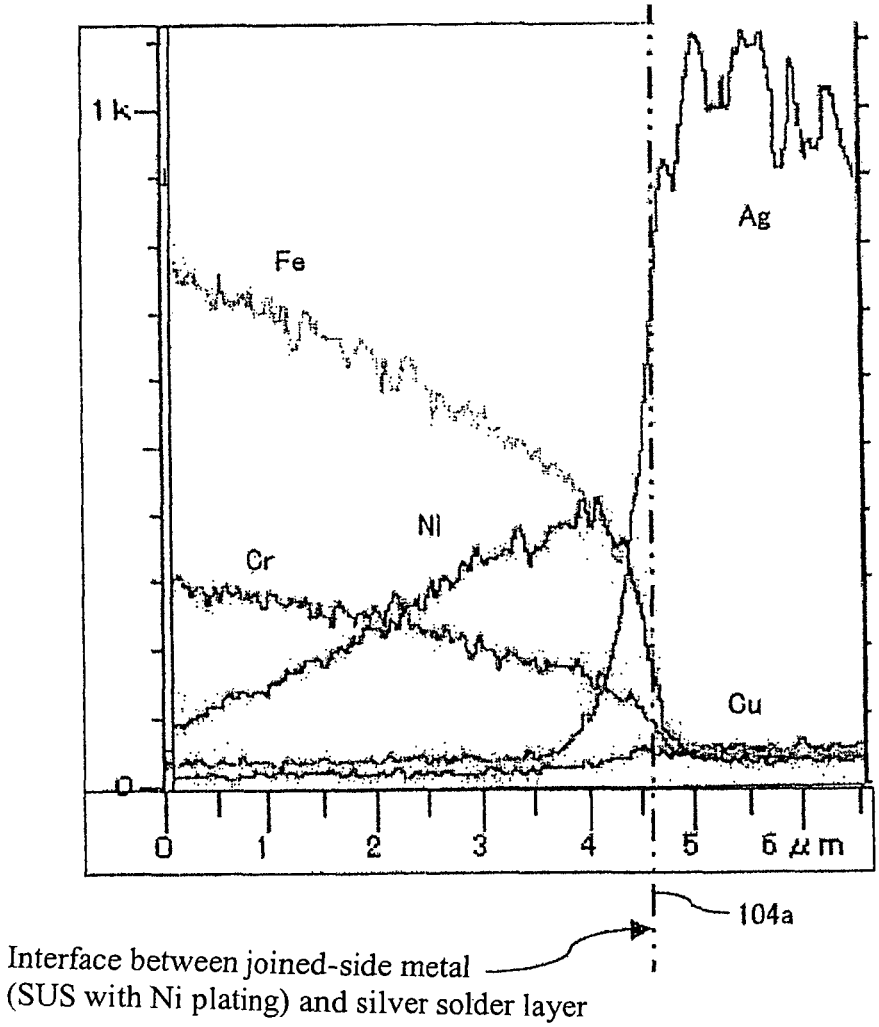
FIG. 7C is a chart summarizing the results of the concentration distribution of various elements measured using EPMA (Electron Probe Microanalysis) in an joint interface region between a joined-side metal and a silver solder layer as per Example 1 for joining a bellows according to an embodiment of the present invention.
Figure 7D:
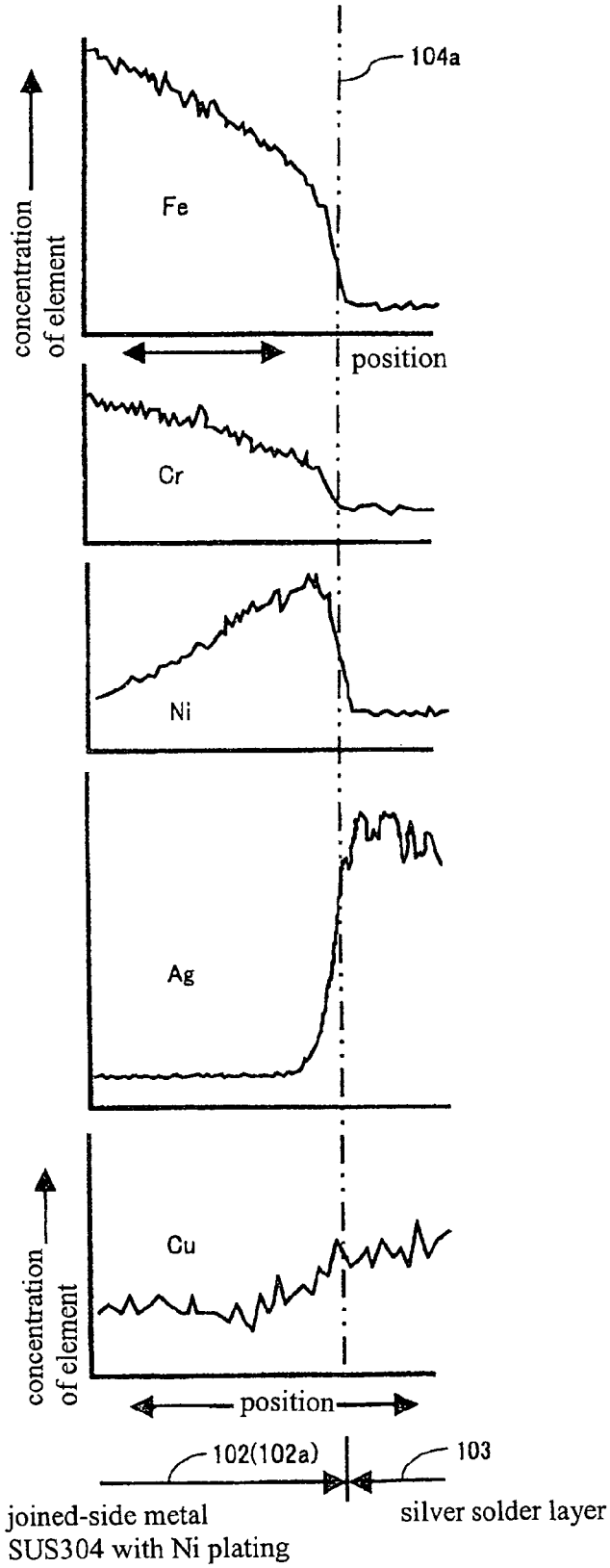
FIG. 7D is charts depicting concentration distributions of individual elements summarized in FIG. 7C with the positions of joint interface of all charts rendered coincident.

FIG. 7C is a chart summarizing the results of concentration distribution of various elements measured by EPMA; and FIG. 7D are charts of concentration distribution of individual elements with the positions of joint interface 104*a* of all charts made coincident.

Figure 8A:
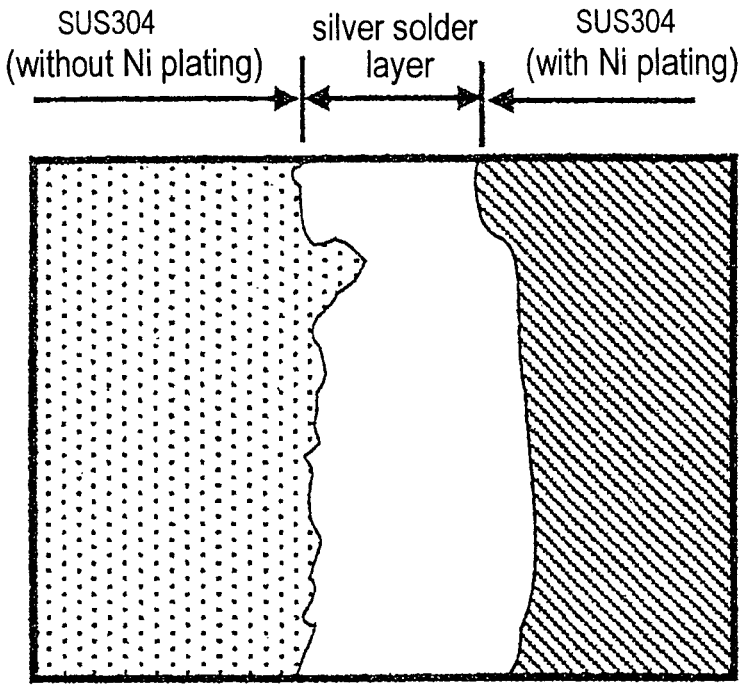
FIG. 8A is a depiction of a soldered part composed of a joined-side metal, a silver solder layer, and a base metal as per Example 1 for joining a bellows according to an embodiment of the present invention.
Figure 8B:
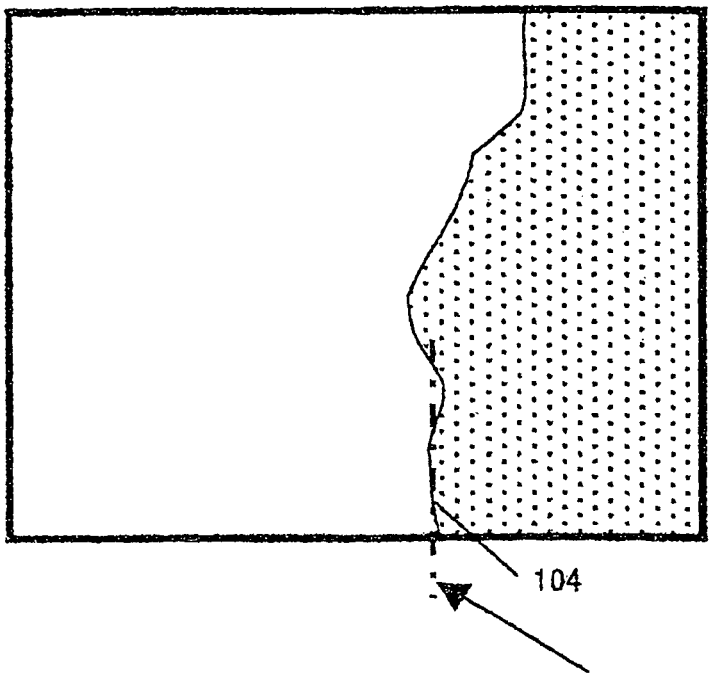
FIG. 8B is a depiction of sectional observation of a joint interface between a base metal and a silver solder layer as per Example 1 for joining a bellows according to an embodiment of the present invention.

FIG. 8A is a depiction of a sectional observation of a soldered part composed of a base metal 101, a silver solder layer 103, and a joined-side metal 102; and FIG. 8B is a depiction of a sectional observation of a joint interface 104 between a base metal 101 and a silver solder layer 103.

Figure 8C:
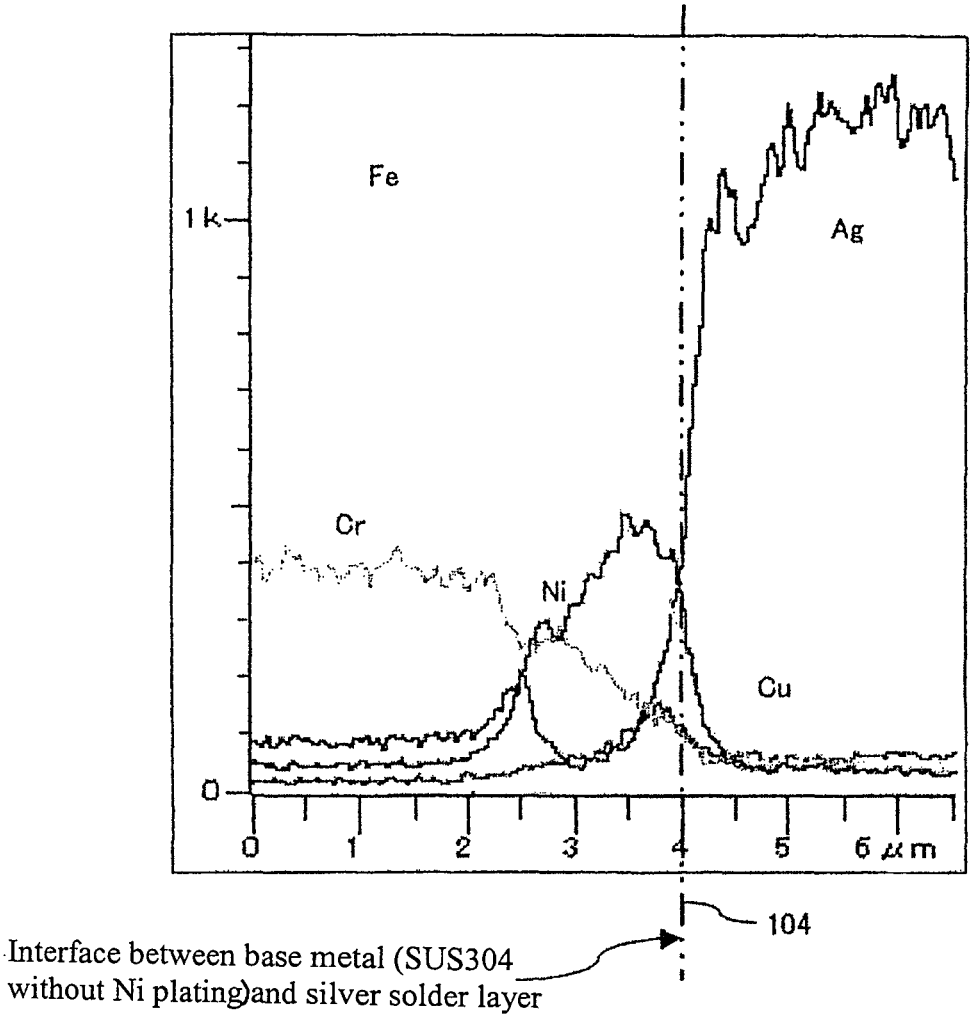
FIG. 8C is a chart summarizing the results of the concentration distribution of various elements measured using EPMA in a joint interface region between a base metal and a silver solder layer in Example 1 for joining a bellows according to an embodiment of the present invention.
Figure 8D:
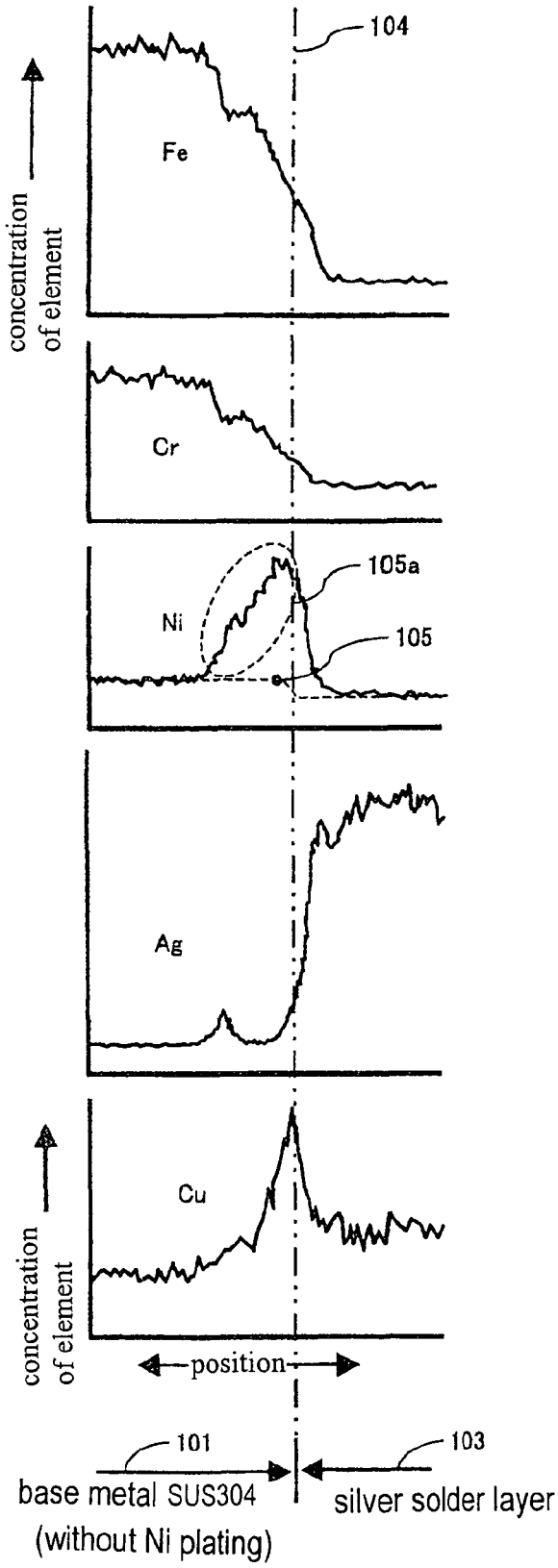
FIG. 8D is charts depicting the concentration distribution of individual elements summarized in FIG. 8C with the positions of joint interface of all charts rendered coincident.

FIG. 8C is a chart summarizing the results of concentration distribution of various elements measured by EPMA; and FIG. 8D are charts of concentration distribution of individual elements with the positions of joint interface 104 of all charts rendered coincident.

In each of the FIGS. 7C, 7D, 8C, and 8D, the ordinate shows count numbers of the elements acquired by EPMA indicating higher concentration in the upper position, and the abscissa shows the location. The double dotted lines in the charts indicate approximate positions of the interface 104 between the base metal 101 of SUS304 without nickel plating and the silver solder layer and the interface 104*a* between the joined-side metal 102 of SUS304 with nickel plating and the silver solder 103. In the analysis charts for each element, FIGS. 7C, 7D, 8C, and 8D are such that the ordinates are arbitrarily enlarged or contracted for ease of understanding.

FIGS. 7A, 7B, 7C, and 7D depict the results of element analysis about the joint interface 104*a* between the joined-side metal 102 of SUS304 with a nickel plating and the silver solder 103. It can be seen that the nickel concentration is relatively high in the surface region of several μm in the joined-side metal 102. This is caused by the nickel plating.

FIGS. 8A, 8B, 8C, and 8D depict the results of element analysis about the joint interface 104 between the base metal 101 of SUS304 without nickel plating and the silver solder 103. Since no nickel plating was provided on the surface of the base metal 101 of SUS304, nickel must be found only inside of the base metal 101 and with an approximately constant concentration distribution corresponding to the composition of the SUS304 as indicated by the dotted line 105 in FIG. 8D. Nevertheless, a peculiar phenomenon was found that a high nickel concentration was observed in the surface region of the base metal 101 of SUS304 in spite of the absence of nickel plating.

This fact has confirmed the assumption described earlier that the nickel plating formed on the SUS304 partly dissolves in the process of soldering and precipitates onto the surface of the opposing SUS304 in the process of solidification as if nickel plating was carried out.

Example 2

Based on the knowledge obtained from the experiments described above, experiments were conducted on soldering of bellows 16 in a vacuum valve 10. The bellows used in the soldering experiments was manufactured by the method of the example shown in FIG. 3. A sheet of austenitic stainless steel (SUS316) was rolled and TIG welded to form a pipe and then formed to a bellows by applying hydraulic pressure. This bellows was a so-called seam type bellows 16 with a welding seam. Nickel plating was not plated.

Joined-side metals soldered with the bellows were a cover 17 that is composed of C1020P or SPCC and has a nickel plating layer 17*a* having a thickness of 2 to 3 μm, and an end plate at movable side 12 that is composed of Fe—42Ni and has a nickel plating layer 12*a* having a thickness of 2 to 3 μm. (See FIG. 2A.)

Figure 9:
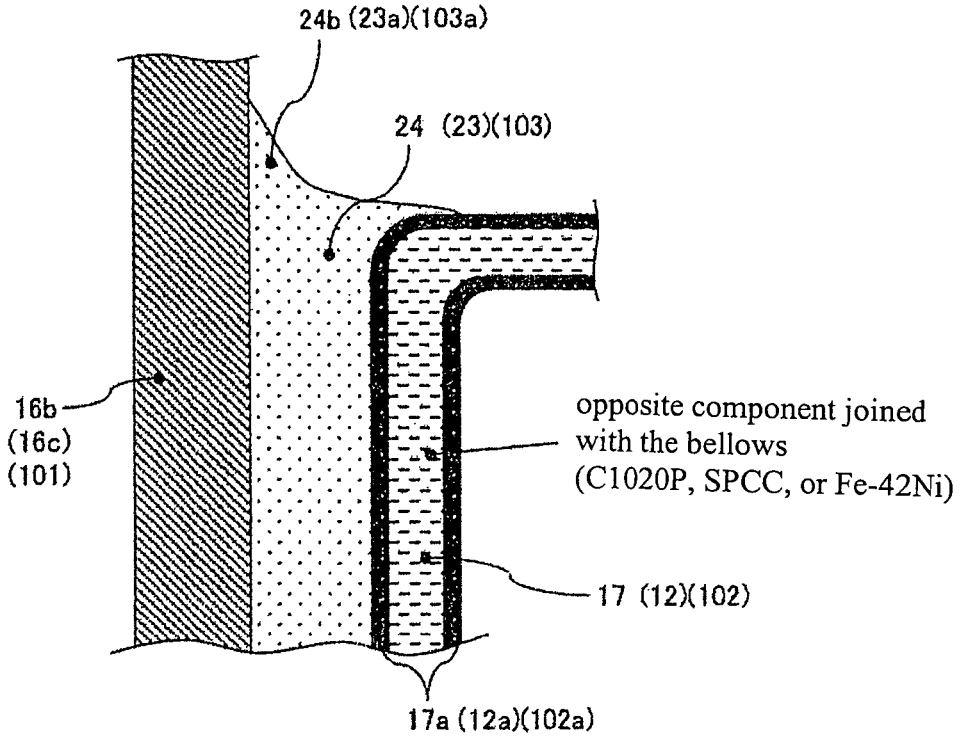
FIG. 9 shows the concept of Example 2 in which a method of joining a bellows according to an embodiment of the present invention is applied to a vacuum valve.

Soldering was conducted in these combinations of materials in the way as described previously, and inspections were made on external appearance and cross sectional structure. It has been bound that fillet 24*b* and fillet 23*a* were formed in every combinations as shown in the example of FIG. 9, demonstrating good soldered state.

FIGS. 10A, 10B, 10C, and 10D depict the results of element analysis by EPMA of the elements of Fe, Cr, and Ni that are principal elements of the bellows 16, Ag and Cu that are components of silver solder, and nickel of the nickel plating layer 17*a* (12*a*) in a section of the soldered part between the bellows 16 without nickel plating and the cover 17 (the end plate at movable side 12) of C1020P with the nickel plating layer 17*a* (12*a*).

Figure 10A:
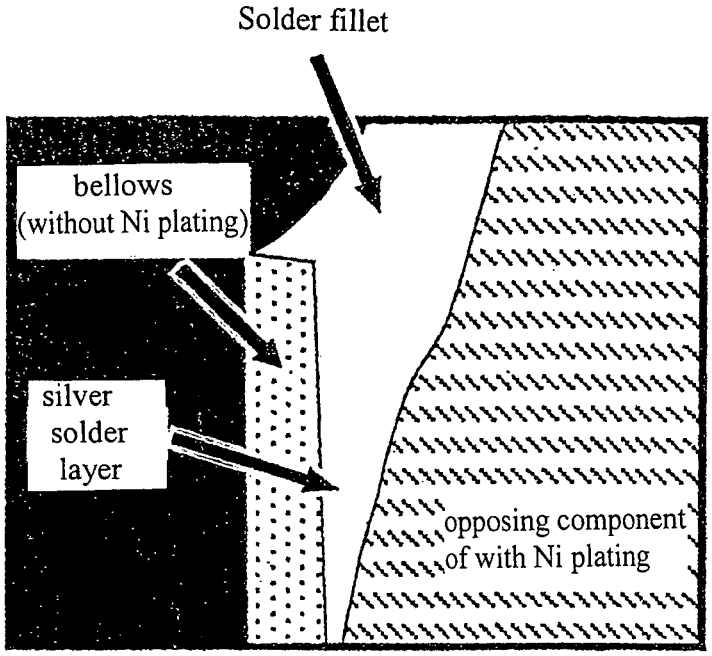
FIG. 10A is a depiction of a sectional observation of a soldered part as per Example 2 for joining a bellows according to an embodiment of the present invention.
Figure 10B:
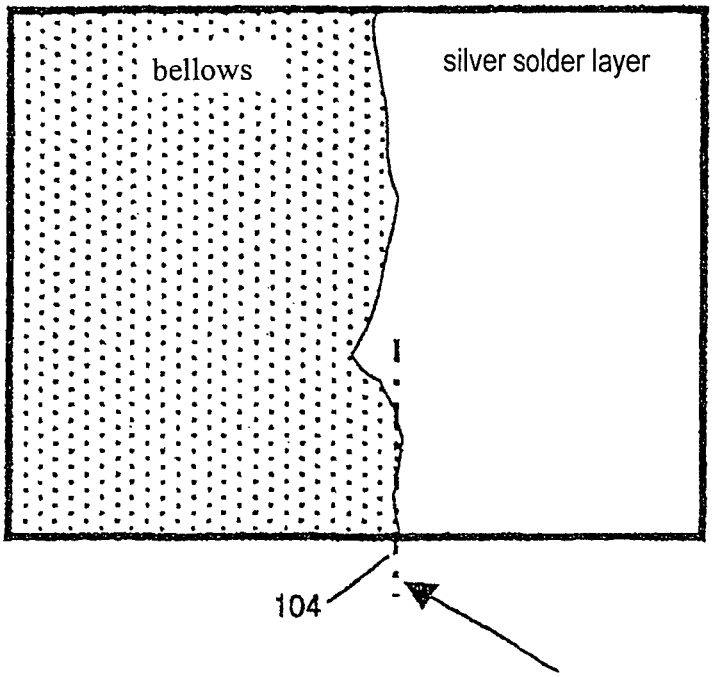
FIG. 10B is a depiction of a sectional observation of a joint interface between a bellows and a silver solder layer as per Example 2 for joining a bellows according to an embodiment of the present invention.

More specifically, FIG. 10A is a depiction of a sectional observation of a solder joint 24 (or solder joint 23) composed of a bellows 16, a silver solder layer, and the cover 17 (or the end plate at movable side 12); and FIG. 10B is a depiction of sectional observation of a joint interface 104 between the bellows 16 and a silver solder layer (at solder joint 24 or solder joint 23).

Figure 10C:
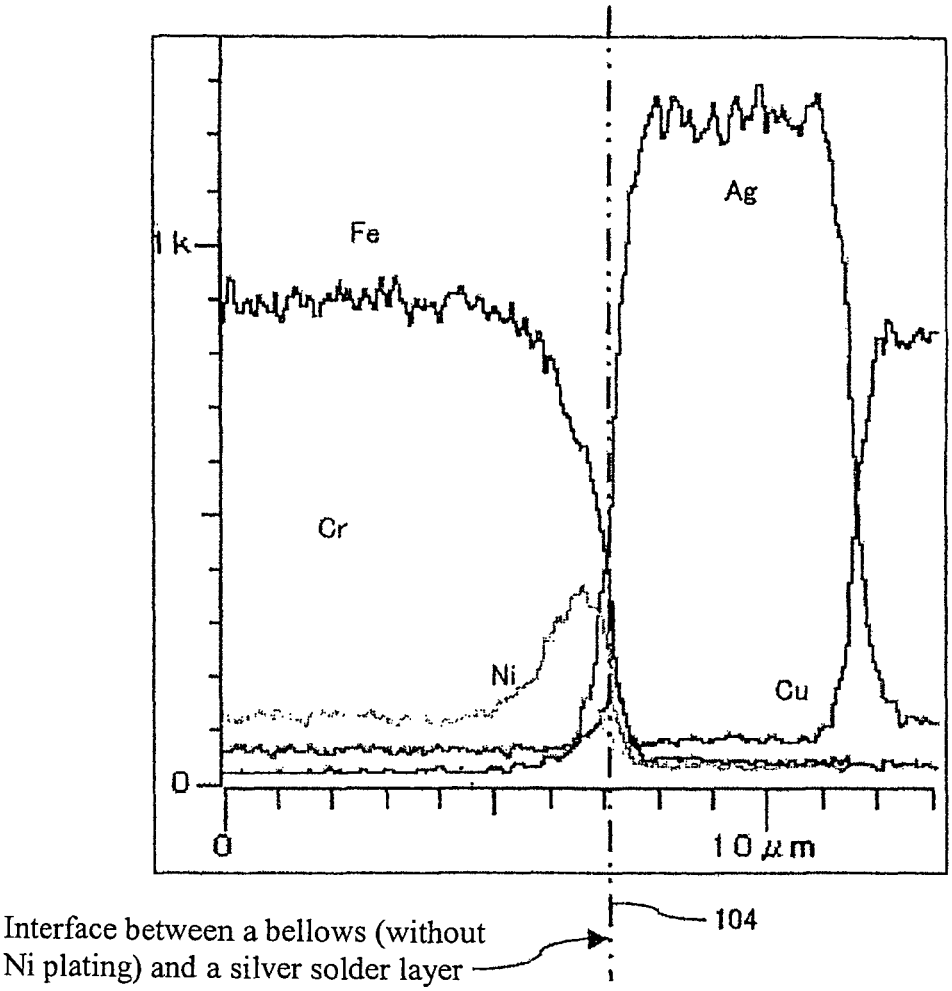
FIG. 10C is a chart summarizing the results of the concentration distribution of various elements measured using EPMA in a joint interface region between a bellows and a silver solder layer as per Example 2 for joining a bellows according to an embodiment of the present invention.
Figure 10D:
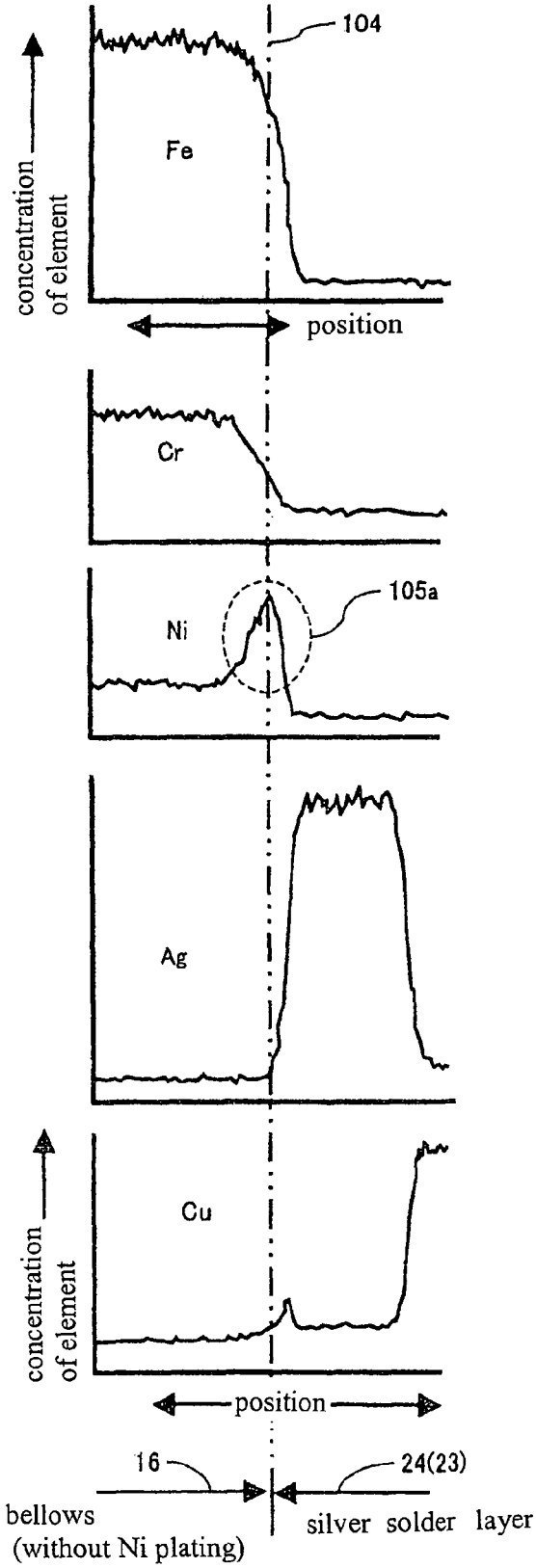
FIG. 10D is charts of the concentration distribution of individual elements summarized in FIG. 10C with the positions of joint interface of all charts rendered coincident.

FIG. 10C is a chart summarizing the results of concentration distribution of various elements measured by EPMA; and FIG. 10D depicts charts of concentration of individual element with the positions of joint interface 104 of all charts made coincident.

In these FIGS. 10A through 10D, a high nickel concentration region 105*a* indicated in FIG. 10D, similar to 105*a* in FIG. 8D, has been observed even on the surface of bellows 16 on which nickel plating was not conducted. This can be attributed to the transfer of nickel component of the nickel plating layer 17*a* to the side of bellows 16 during the soldering process.

While above-described are in the case of C1020 for the materials of the cover 17 and the end plate at movable side 12 to be joined with the bellows 16, similar results have been obtained in the cases of materials of austenitic stainless steel, mild steel, and sealing alloys of Fe—Ni and Fe—Ni—Co.

Time variation of the pressure (degree of vacuum) in the vacuum valve 10 produced by the joining method according to the invention was measured, and no decrease of the pressure or degradation of vacuum was observed. This demonstrates satisfactory hermetic joints at the solder joint 24 between the bellows 16 and the cover 17 and the solder joint 23 between the bellows 16 and the end plate at movable side 12.

As described thus far, in the joining of the bellows of a vacuum valve 10 according to an embodiment of the present invention, nickel plating is not carried out on the bellows 16 made of stainless steel, for example. Instead, the cover 17 and the end plate at movable end 12, which are opponent component to the bellows and have relatively simple shape, are provided with a nickel plating layer 17*a* and a nickel plating layer 12*a*, respectively, and soldered. Elimination of metal plating on the bellows 16 achieves cost reduction and joining with high air tightness and joint strength.

Further cost reduction is obtained because a bellows used can be an inexpensive seam type bellows that is made by forming a thin pipe with a welding seam. A cost of a seam type bellows is about one third of a cost of a seamless type bellows. Thus, significant cost reduction can be achieved.

A seamless type bellows 16 in its as-manufactured form has straight cylindrical parts, an opening end portion 16*b* and opening end portion 16*c*, in both ends thereof. As a result, simple structures of solder joint 23 and solder joint 22 can be constructed using inner or outer surface of these opening end portions 16*b* and 16*c* for joining surface of soldering.

Therefore, improvements can be expected in maintaining air tightness for a long period at solder joints 23 and 22 as compared with the complicated stacked structure disclosed in Japanese Patent Unexamined Publication No. 2001-6503.

The above descriptions mentioned joining techniques at joining places of the bellows 16 in the vacuum valve 10. Joining process in the vacuum valve 10 of an example shown in FIG. 1 can be carried out in a vacuum furnace simultaneously for all solder joint including solder joint 21, solder joint 22, solder joint 23, solder joint 24, solder joint 25, and solder joint 26.

The parts of vacuum valve 10 having the structure of FIG. 1 are temporarily assembled as in FIG. 1 and solder materials are arranged at the solder joints 21 through 26. The viscosity of the solder material may be utilized for relative positioning of the parts in the temporary assembling. The parts are placed in the vacuum furnace and heated up as a whole to a soldering temperature of for example, 800° C. to 850° C. to assemble by soldering.

Since the both ends of the seam type bellows 16 in this embodiment are an opening end portions 16*b* and 16*c* having a simple cylindrical shape, temporary assembling can be readily carried out just by coaxially arranging a cover 17, a bellows 16, an end plate at movable side 12, and a movable contact element 14. This resides in a further merit of the embodiment.

In the heating process, the components involved with the bellows 16 as shown in FIG. 2A are located inside the insulative cylinder 11, and so receive less radiation from the furnace.

Nevertheless, since the soldering can be carried out at a soldering temperature of about 800° C. in this embodiment, simultaneous assembling of the vacuum valve 10 can be accomplished by setting the furnace temperature at about 850° C. and heating the components including the bellows located inside the insulative cylinder 11 up to about 800° C.

The invention is not limited to the examples of embodiment described above, and a wide range of variations are possible without departing from the scope and spirit of the invention.

For example, the metal plating onto the end plate at movable side 12 and the cover 17 is not limited to nickel plating, and can be gold (Au) plating. Further, in at least one embodiment, the above-mentioned end plate 12 and the cover 17 comprise stepped annular members which are arranged so that, as shown in FIG. 1, for example, the steps 12*c* and 17*c* form annular spaces into which the ends of the bellows can be received and be welded to the plated surfaces of the end plate and cover 12 and 17.

The disclosure of Japanese Patent Application No. 2005-305317 filed on Oct. 20, 2005 is incorporated herein as a reference.

What is claimed is:

1. A vacuum valve comprising a hermetically sealed vessel accommodating a fixed contact piece and a movable contact piece, the hermetically sealed vessel comprising:

a cover as a first structural member having a metal plating thereon for covering the same, said cover being formed separately from the movable contact piece to form the metal plating and connected thereto, said cover comprising a cover inner portion having a through hole through which the movable contact piece passes, a flange located outside the cover inner portion and displaced from the cover inner portion, and a cover vertical portion extending perpendicular to the cover inner portion and flange and connected thereto to thereby form a step part by the cover vertical portion and the cover inner portion, a bellows substantially free of metal plating and having one end portion and the other end portion, and an end plate as a second structural member having a metal plating thereon, said end plate comprising a plate inner portion having a through hole to allow the movable contact piece to pass therethrough, a plate outer portion located outside the plate inner portion and displaced from the plate inner portion, and a plate vertical portion extending perpendicular to the plate inner and outer portions and connected thereto, wherein the first structural member is interposed between the movable contact piece and the bellows such that the one end portion of the bellows is soldered with the cover vertical portion, and the other end portion of the bellows is soldered with the plate vertical portion of second structural member.

2. The vacuum valve according to claim 1, further comprising a solder for connecting the bellows, said solder having a solder fillet formed at a side of the bellows of a soldered portion between the bellows and the cover vertical portion, and another solder fillet formed at a side of the bellows of a soldered portion between the bellows and the plate vertical portion.

3. The vacuum valve according to claim 2, wherein the flange is located above the cover inner portion, and the plate outer portion is located below the plate inner portion.

4. A vacuum valve comprising:

a fixed contact piece and a movable contact piece, a hermetically sealed vessel accommodating the fixed contact piece and the movable contact piece, a cover for the movable contact piece having a metal plating thereon, said cover being formed separately from the movable contact piece to form the metal plating thereon and connected thereto, said cover comprising a cover inner portion having a through hole through which the movable contact piece passes, a flange located outside the cover inner portion and displaced from the cover inner portion, and a cover vertical portion extending perpendicular to the cover inner portion and flange and connected thereto to thereby form a step part by the cover vertical portion and the cover inner portion, a bellows substantially free of metal plating, and having one end portion and the other end portion, an end plate for the sealed vessel, said end plate having a metal plating thereon and comprising a plate inner portion having a through hole to allow the movable contact piece to pass therethrough, a plate outer portion located outside the plate inner portion and displaced from the plate inner portion, and a plate vertical portion extending perpendicular to the plate inner and outer portions and connected thereto, a first solder between the cover vertical portion and the one end of the bellows, and a second solder between the plate vertical portion and the other end portion of the bellows, wherein the cover is interposed between the movable contact piece and the bellows and is soldered with the one end portion of the bellows, the other end portion of the bellows is soldered with the end plate, the first solder contains a metallic component transferred from the metal plating to the cover, and the second solder contains a metallic component transferred from the metal plating to the end plate so that the bellows can be securely soldered to the cover and the end plate by the metallic components transferred from the metal plating.

5. The vacuum valve according to claim 4, wherein the first solder includes a solder fillet formed at a side of the bellows of a soldered portion between the bellows and the cover, and the second solder includes another solder fillet formed at a side of the bellows of a soldered portion between the bellows and the end plate.

* * * * *

UNITED STATES PATENT AND TRADEMARK OFFICE

CERTIFICATE OF CORRECTION

PATENT NO. : 8,497,445 B2
APPLICATION NO. : 11/516787
DATED : July 30, 2013
INVENTOR(S) : Shoji Yoshida et al.

It is certified that error appears in the above-identified patent and that said Letters Patent is hereby corrected as shown below:

On title page, item (75):
Change the first inventor's residence, "Fukiege-machi (JP);" to --Fukiage-machi (JP);--.

In specification:

Column 6, line 46, change "a cup-shaped are" to --a cup-shaped arc--.

Column 9, line 4, change "and are discharge." to --and arc discharge.--.

Column 10, line 47 and Column 14, line 14, change "800°C. to 850°C." to --800°C to 850°C--.

Column 14, line 28, change "about 800°C." to --about 800°C--.

Column 14, line 31, change "850°C. and heating" to --850°C and heating--.

Signed and Sealed this
Eighteenth Day of February, 2014

Michelle K. Lee

Michelle K. Lee
*Deputy Director of the United States Patent and Trademark Office*